US006716296B2

(12) United States Patent
Chum

(10) Patent No.: US 6,716,296 B2
(45) Date of Patent: Apr. 6, 2004

(54) METHOD OF MANUFACTURE FOR EASY-OPEN FILM BAG

(76) Inventor: Tung Hang Chum, Flat F. 5/F, Leapont Industrial Bldg. 18-28 Wo Liu Hang Road Fo Tan, Shatin, New Territories (CN)

( * ) Notice: Subject to any disclaimer, the term of this patent is extended or adjusted under 35 U.S.C. 154(b) by 145 days.

(21) Appl. No.: 09/928,960

(22) Filed: Aug. 13, 2001

(65) Prior Publication Data

US 2002/0185405 A1 Dec. 12, 2002

(30) Foreign Application Priority Data

Jun. 12, 2001 (CN) ..... 01114789 A
Jun. 12, 2001 (CN) ..... 01242078 U

(51) Int. Cl.[7] ..... B32B 31/20
(52) U.S. Cl. ..... 156/290; 206/554; 383/7; 383/9; 383/32; 383/37; 493/186; 493/189
(58) Field of Search ..... 156/290; 206/554; 383/7, 9, 32, 37; 493/186, 267, 189

(56) References Cited

U.S. PATENT DOCUMENTS 5,863,130 A * 1/1999 Nguyen ..... 383/9
6,079,877 A * 6/2000 Chew ..... 383/8
6,149,007 A * 11/2000 Yeh et al. ..... 206/554

* cited by examiner

*Primary Examiner*—Jeff H. Aftergut
*Assistant Examiner*—Jessica Rossi
(74) *Attorney, Agent, or Firm*—Alix, Yale & Ristas, LLP

(57) ABSTRACT

A manufacturing method for plastic bags recombines a layer of plastic to the outside surface of the bag to provide a portion of the outside surface with a lower melting point than the inside surface of the bag. The bags are arranged in stacks and heat is applied to bond the low melting point layer. A relatively weak bond is formed between adjacent outside bag surfaces while the bag inside surfaces remain free of each other. The weak bond is positioned along the median of the bag and near the bag opening. A second bag is drawn open by the bond during retrieval of a first bag. A flexible separation tab is arranged to maintain the separation between the inside surfaces of the open bag. The separation tab may also be made conspicuous to present an obvious retrieval point for the top bag in a hanging bag dispensing arrangement.

6 Claims, 3 Drawing Sheets

METHOD OF MANUFACTURE FOR EASY-OPEN FILM BAG

BACKGROUND OF THE INVENTION

1. Field of the Invention

This invention relates to the manufacture and dispensing of plastic bags and more particularly to a manufacturing method and arrangement of multiple plastic bags from which open bags are dispensed individually and which presents an conspicuous retrieval point for each bag.

2. Description of the Related Art

Plastic bags have become the preferred means for packaging goods sold in shops and markets throughout the world. As manufacturing techniques become more sophisticated, bags have become extremely thin, complicating their storage, dispensing and use. Currently, it is known to stack multiple thin film plastic bags and bond them together at one or more points so that the assembled stack of bags can be stored and displayed neatly. The bonded portions are typically not part of the bag itself but part of a bag root from which each bag breaks away at perforations between the bag and bag root.

Typically, the consumer or clerk grasps any convenient portion of the bag and exerts pulling force to break the perforations and separate a bag from the bag root. This motion does not usually open the bag. The thin film from which bags are constructed is inherently flimsy and prone to static charge. The limp nature of the film combined with static charges cause the inner layers of the bag to cling together, making opening of the bag inconvenient and time consuming. Frequently, opening the bag requires extensive manipulation that potentially contaminates the bag. Additionally, the user frequently grasps and retrieves more than one bag. This often results in unused bags being thrown away.

There is a need in the art for an arrangement for dispensing plastic bags which is not only practical for transportation and display but also overcomes the inconveniences associated with bag retrieval and opening as described above.

SUMMARY OF THE INVENTION

Briefly stated, a preferred embodiment of the invention comprises the manufacture of a thin film plastic bag where the body of the bag is high-density polyethylene (HDPE) with a strip of low-density polyethylene (LDPE) applied to a portion of front and back outside surfaces of the bag. The LDPE has a lower melting point than the HDPE. The invention then utilizes the different melting points to form an easily breakable bond connecting the outside surfaces of adjacent bags in a stack. Thus, when a first bag is retrieved from the stack of bags, it draws with it the front side of the following bag while the bond to the next bag restrains the rear side. In this manner, the clerk or consumer is always presented with an obvious and conveniently graspable portion of an already open bag for retrieval. Physical manipulation, i.e., shaking, blowing or rubbing is not required to open the bag, lowering the chances of contamination. Bags are retrieved individually, overcoming the common problem in the prior art where multiple bags are retrieved in error.

In accordance with a further aspect of the invention, a flexible separation tab is attached to the stack of bags in a position to separate the front and back portions of the top bag in the stack. The separation tab deflects from this position as the top bag is retrieved, then moves back into place separating the front and back portions of the following bag. The separation tab may be brightly colored to indicate a highly visual and well defined retrieval point. Thus, a clearly delineated retrieval point is presented, eliminating the grasping of multiple bags.

In accordance with another aspect of the invention, the inventive composite HDPE/LPDE bag and bonding method may be applied to known hanging bag arrangements as well as stacks of bags that are dispensed from a box or other container. In either configuration, a clearly defined retrieval point is presented to the clerk/consumer and bags are dispensed open and one at a time.

It is an object of the present invention to provide a new and improved plastic bag, arrangement for dispensing plastic bags and manufacturing method for plastic bags and plastic bag dispensing arrangements which ensure the dispensing of individual bags that are open and ready for use.

Another object of the present invention is to provide a new and improved thin film plastic bag that permits a stack of the bags to be assembled in which retrieval of a bag opens the following bag.

A further object of the present invention is to provide a new and improved dispensing arrangement of plastic bags which presents a clearly defined retrieval point to the user.

These and other objects, features, and advantages of the invention will become readily apparent to those skilled in the art upon reading the description of the preferred embodiments, in conjunction with the accompanying drawings.

DETAILED DESCRIPTION OF THE PREFERRED EMBODIMENT

Figure 1:
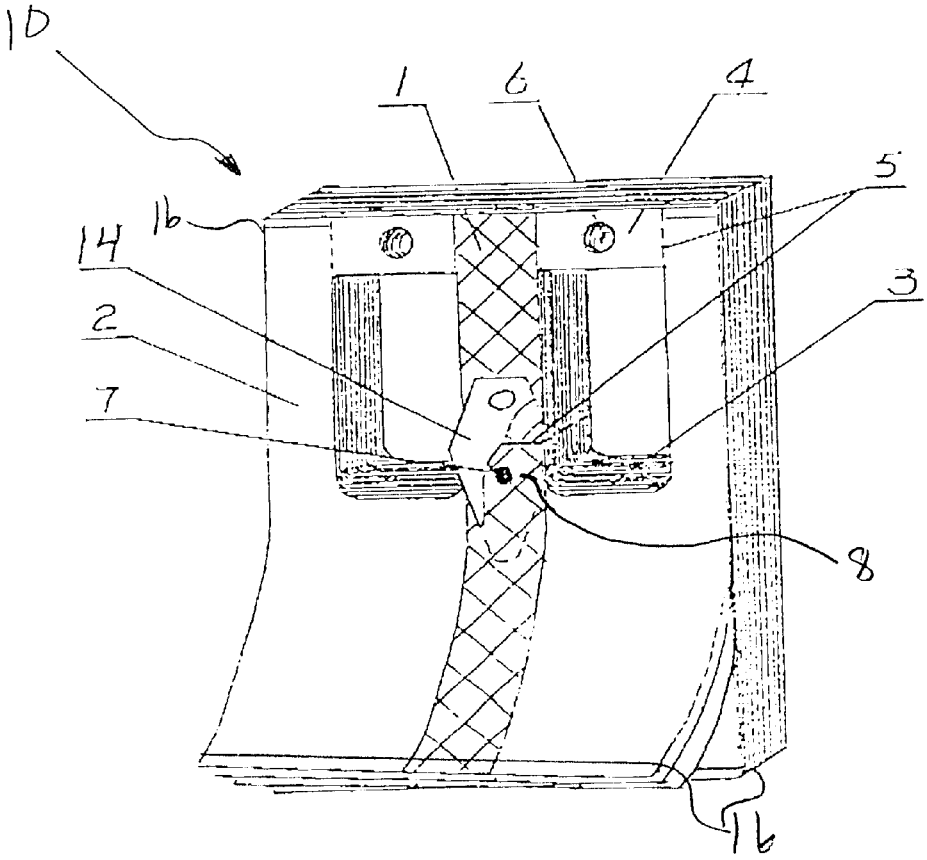
FIG. 1 is a front plan view of a hanging dispensing arrangement of bags in accordance with the present invention.
Figure 2:
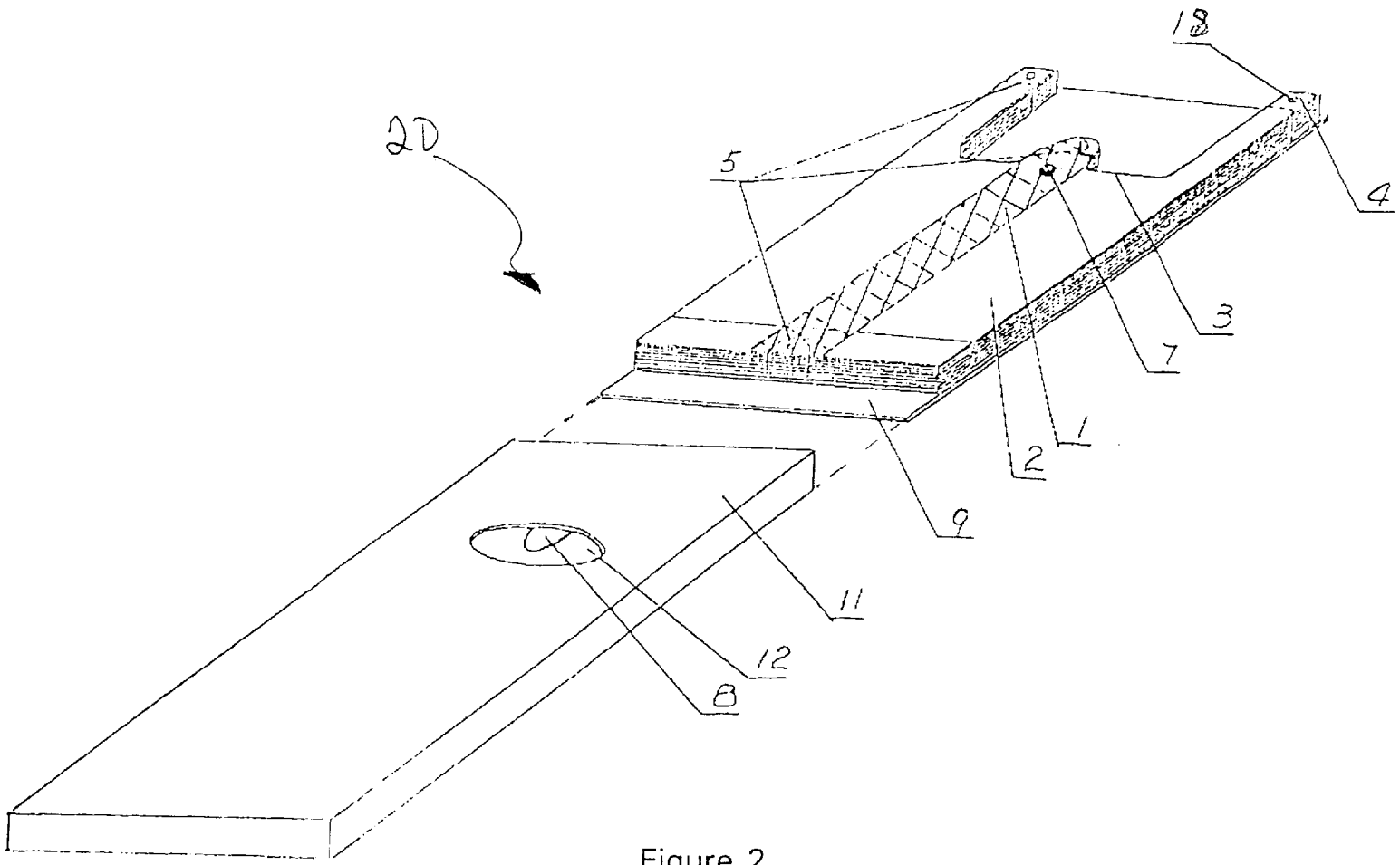
FIG. 2 is an exploded view of an arrangement of bags to be dispensed from an enclosure in accordance with the present invention.
Figure 3:
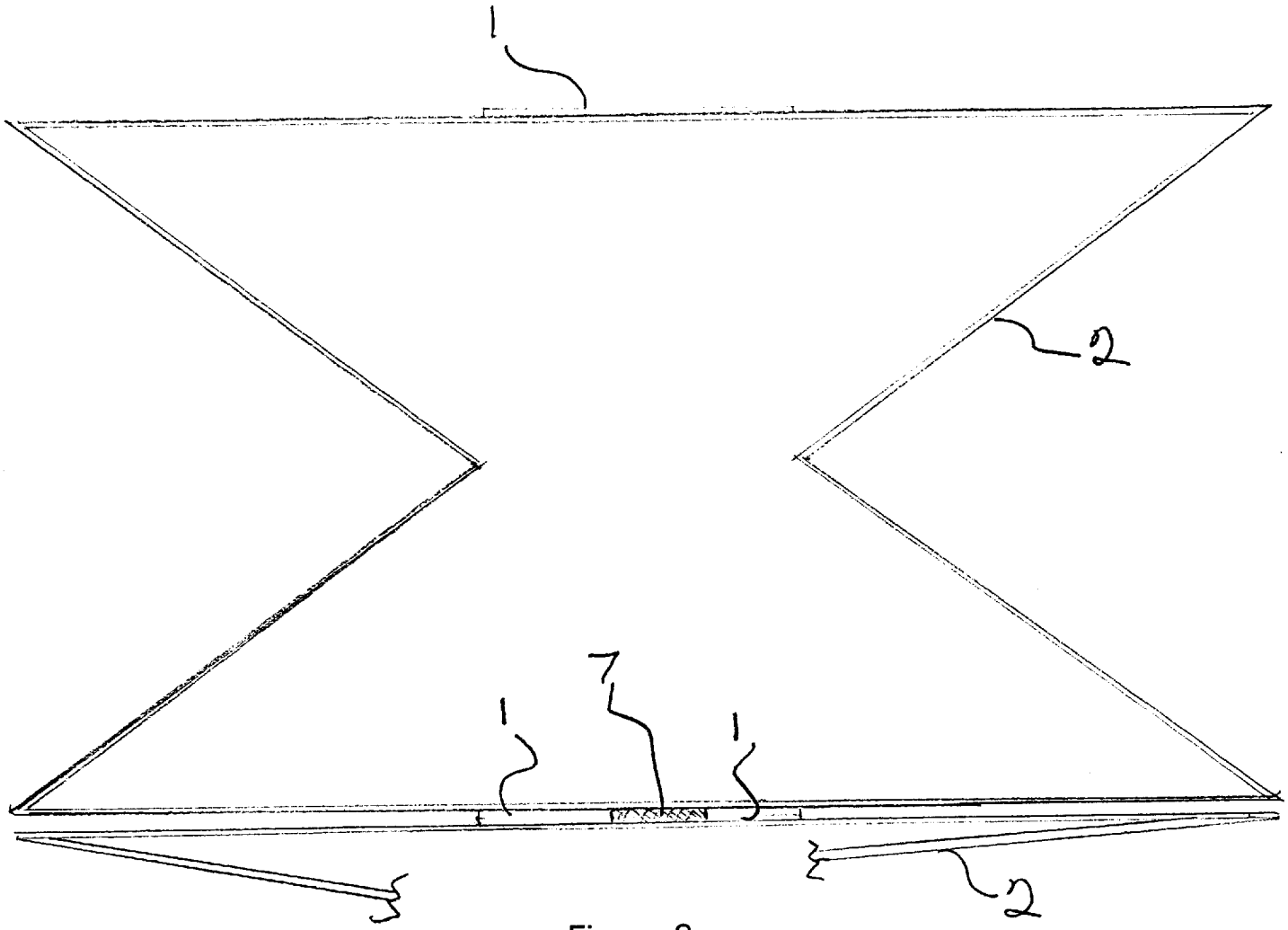
FIG. 3 is a sectional end view through one full bag and a partial second bag illustrating the bond between outside bag layers in accordance with the present invention.

Referring more particularly to FIGS. 1 through 3, wherein like numerals refer to similar parts, FIG. 1 illustrates a hanging dispensing arrangement 10 of film bags 2 in accordance with the present invention. The bags 2 are primarily manufactured from high-density polyethylene (HDPE). The HDPE preferably has a molecular weight in the range of between 0.935 and 0.95. HDPE of this molecular weight will typically have a softening/melting point in a range of from 135° C. to 160° C. HDPE bags of conventional thickness have proven to be practical for purposes of implementation of the present invention.

In accordance with one aspect of the present invention, during extrusion of the bags a layer of low-density polyethylene (LDPE) 1 is applied to a portion of both primary outside surfaces, i.e., the front and back outside surfaces of each film bag 2. The LDPE preferably has a molecular weight in the range of approximately 0.92 or less. LDPE having this molecular weight will typically have a softening/melting point in the range of from 90° C. to 105° C. The LDPE is preferably applied in a layer thickness of less than 0.002 mm and more preferably less than 0.001 mm.

The bags are manufactured using common extrusion and partial combination. These methods of plastic bag manufacture are well known and understood by those of skill in the art. During bag manufacture the LDPE is included during extrusion of the bag material. The HDPE and LDPE are extruded at the same time. The LDPE material is then partially combined on the outside of the HDPE bag material to form an external layer. At the extrusion stage, the bag material may extruded as a tube or as a sheet. The LDPE is preferably applied in a strip along a portion of the bag material that will be positioned at the median of the finished bags. Thus, in accordance with one aspect of the present invention, when the bags are stacked and cut, the LDPE strip preferably coincides with the center of the bag opening.

FIG. 3 is a sectional view through one bag and a partial second bag. The bag body 2 is constructed of HDPE, which in this case is extruded as a tube. A strip of LDPE 1 is partially combined or bonded to opposite outside surfaces of the HDPE tube. The tube is folded, cut and formed into bags as described herein. Heat is applied to form a bond 7 between the external LDPE portions 1. The temperature applied is in a range to partially melt the LDPE but is insufficient to soften or melt the HDPE bag body 2. The inside surfaces of the bag, being constructed of HDPE, remain free of each other.

Individual bags 2 are cut from the extruded tube or formed from the sheet bag material as is known in the art. The illustrated bags 2 are formed from an extruded tube of bag material and are of the type having symmetrical handles on either side of an opening. An area of the extruded tube above the opening and between the handles is utilized as a bag root 4. In manufacturing steps, perforations 5 are provided between the bag root 4 and the bag 2, while a seal 16 is applied to the top of the handles and the bottom of the bag. Some of the HDPE material is removed and recycled into additional bags. Of course the invention as herein described is compatible with other bag configurations.

Melted through holes 6 connect all the bag roots 4. Individual bags 2 separate from the connected bag roots at the perforations 5. The through holes 6 permit the dispensing arrangement 10 to be hung in a convenient location for use by the consumer or clerk as is currently known in the art.

FIG. 1 illustrates a hanging arrangement for dispensing bags 2. In accordance with one aspect of the present invention, the bags are stacked in multiples of approximately 50 to 300, although other smaller or larger stacks may be desirable. Heat and pressure are applied to the stacked bags in a location corresponding to the LDPE film portion. As an example: For a stack of 100 bags manufactured from HDPE film of 0.007 mm thickness with an LDPE layer of less than 0.001 mm thickness, heat is applied by means of heated pressure points disposed on opposite sides of the stack. The configuration and position of the heated pressure points determines the configuration and position of the resulting bond 7 between bag outside surfaces. A temperature of approximately 100° C. is applied for a period of approximately 30 seconds. As a result, a bond 7 is formed between the LDPE layers joining only the outside surfaces of adjacent bags in the stack.

The bag bodies comprised of HDPE have a higher melting point than the LDPE layer. As a result, while the outside surfaces of adjacent bags are joined, the inside surfaces of the bags remain separate. Further, the bond formed between the thin LDPE layers on the outside surfaces of the bags is relatively weak. A thicker LDPE layer would result in an undesirably robust bond. The LDPE layer is preferably less than 0.002 mm in thickness and even more preferably less than 0.001 mm. Thus, when a consumer or clerk grasps a first bag, the inside surfaces separate easily. The front portion of a first bag is retrieved by the user while the rear portion of the first bag is held back via its connection 7 to the following bag. Each bag is opened in a reliable and predictable manner. Further, during retrieval of a bag, the front portion of the following bag is pulled away from the rear layer.

In accordance with a further particular aspect of the invention, a flexible separation tab 14 is arranged to maintain the separation between front and rear layers initiated by retrieval of the previous bag. The separation tab 14 flexes out of the way while a bag is being retrieved but falls back to maintain the separation between the layers of the next bag in the stack. The separation tab 14 is preferably solid brightly colored heavy gage polyethylene. The separation tab clearly indicates where the next bag is to be grasped and retrieved. The top surface of the next bag will always be sequentially separated from the stack by the separation tab 14. The separation tab 14 may be fixed to the bag root (as illustrated), may be clipped on or otherwise arranged to remain adjacent the bag opening.

FIG. 2 illustrates an alternative dispensing arrangement 20 of bags configured to be dispensed from a box or other container. The bags incorporated into this arrangement are for all practical purposes identical to the bags described with respect to the arrangement of FIG. 1. The manufacturing of the bags 2 and formation of the bonds 7 between bags are carried out as described above with reference to the hanging dispensing arrangement 10.

In the contained dispensing arrangement 20, the bag root 4 consists of portions adjacent each handle and a portion adjacent the bag opening. The bags are formed and stacked as described above. The bag root portions 4 are melted together. The thermal bond 7 is then formed as described above with reference to hanging dispensing arrangement 10. The thermal bond 7 joins the outside surfaces of adjacent bags as previously discussed. In the illustrated embodiment, the stacked, bonded bags are arranged on and fixed to a rigid baseboard 9 by the bag roots 4. Perforations 5 are provided between the bag roots and the bags themselves. Other bag dispensing configurations that may include other LDPE layer configurations may to one of skill in the art. The illustrated embodiments are given by way of illustration only and are not intended to limit the invention disclosed herein.

The stacked bonded bags and baseboard 9 are inserted into a box, plastic sack 11 or other container having an opening 12. The opening 12 is arranged so that a retrieval portion 8 of the top bag protrudes from the opening. The container may be a permanently mounted, re-fillable dispenser (not illustrated). The clerk or consumer grasps the retrieval portion 8 to retrieve a bag. The bond 7 between outside layers of the bags restrains the rear portion of the bag being retrieved. This forces the bag to open while being retrieved. Each bag separates from the bag roots 4 along perforations 5. The bond 7 pulls the next retrieval portion 8 through the opening breaking the first perforations 5 adjacent the upper central bag root 4.

In this illustrated embodiment 20 and in accordance with another aspect of the present invention, the connection between bag 2 and root 4 formed by perforations 5 adjacent the upper central bag route is preferably less robust than the connection between bag 2 and root portions formed by perforations adjacent the handle bag roots 4. The thermal bond 7 between adjacent bag outside layers thus is strong enough to break the perforation at the upper central bag root and pull the next retrieval portion 8 through the opening before the bag connections to the handle roots restrain the bag and break the bond 7. Only the bag being retrieved is touched or exposed to the atmosphere. This arrangement maintains the stacked bags neatly and in a clean environment.

The strength of the thermal bond 7 and the connections formed by the perforations can be adjusted as necessary to provide a desired bag-opening and tear off properties for a given bag dispensing arrangement. Thermal bonds having a larger surface area will be stronger than thermal bonds having a smaller surface area. Multiple bonds are stronger than single bonds. Perforated connections in which the webs of bag material between perforations are smaller will be weaker than perforated connections in which the webs of bag material are more substantial. Also, the thickness of the bag film and thickness of the low melting point layer will affect the strength of the thermal bond and perforated connections.

A preferred embodiment of extruded HDPE bag with LDPE partial layer has been disclosed. It will occur to those skilled in the art that other bag materials might utilize the principles of the present invention. For example, a polypropylene bag material with a layer of LDPE may prove to be a practical embodiment of the invention. Other polymer films or sheet materials may also be applicable.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A method of manufacturing a dispensing arrangement of plastic bags, each said bag having a sealed bottom, an open top, a front side and a back side and an inside layer comprising a first material having a first melting temperature, said method comprising the steps of:

providing each plastic bag with an outside layer consisting essentially of a longitudinal stripe of a second material on the front and the back of each said bag, said second material having a second melting temperature lower than said first melting temperature;

arranging a plurality of said bags in a stack with the longitudinal stripe of each bag in contact with the longitudinal stripe of a preceding and a subsequent bag; and applying heat and pressure to said stack at a location aligned with said longitudinal stripes, said heat and pressure sufficient to form a bond between the longitudinal stripes of adjacent bags without forming a bond between the inside surfaces of any bags in the stack.

2. The method of claim 1, comprising the steps of:

providing each bag with a bag root connected to said open end by a perforated attachment;

attaching the roots of the bags in said stack to each other; and securing a flexible separation tab to said roots adjacent the open ends of said bags, said separation tab configured to project into the open end of a top bag in said stack.

3. The method of claim 1, wherein said step of providing each bag with an outside layer comprises:

co-extruding said stripes with said inside layer.

4. The method of claim 1, wherein said step of providing each bag with an outside layer comprises:

co-extruding said stripes with said inside layer, said stripes centered on the front and back of each said bag.

5. The method of claim 1, wherein said step of applying heat comprises:

applying heat of approximately 100° C. by means of a heated element.

6. The method of claim 5, wherein said step of applying heat further comprises: applying a constant pressure to said stack through said heated element.

* * * * *